US008217638B1

(12) United States Patent
Li et al.

(10) Patent No.: US 8,217,638 B1
(45) **Date of Patent: *Jul. 10, 2012**

(54) LINEAR REGULATION FOR USE WITH ELECTRONIC CIRCUITS

(75) Inventors: Ying Tian Li, Singapore (SG); Sakti P. Rana, Singapore (SG); Kuong Hoo, legal representative, New Tech Park (SG)

(73) Assignee: Marvell International Ltd., Hamilton (BM)

( * ) Notice: Subject to any disclaimer, the term of this patent is extended or adjusted under 35 U.S.C. 154(b) by 0 days.

This patent is subject to a terminal disclaimer.

(21) Appl. No.: 12/858,735

(22) Filed: Aug. 18, 2010

Related U.S. Application Data

(63) Continuation of application No. 12/264,118, filed on Nov. 3, 2008, now Pat. No. 7,782,041, which is a continuation of application No. 11/095,039, filed on Mar. 30, 2005, now Pat. No. 7,446,514.

(60) Provisional application No. 60/621,411, filed on Oct. 22, 2004.

(51) Int. Cl.
*G05F 5/00* (2006.01)

(52) U.S. Cl. ..... 323/303; 323/280; 323/281

(58) Field of Classification Search ..... 323/303, 323/280, 281, 273, 316, 274
See application file for complete search history.

(56) References Cited

U.S. PATENT DOCUMENTS

| | | | | |
|---|---|---|---|---|
| 5,280,233 | A * | 1/1994 | Poletto et al. | 323/269 |
| 5,563,501 | A | 10/1996 | Chan | |
| 5,686,821 | A | 11/1997 | Brokaw | |
| 6,300,749 | B1 | 10/2001 | Castelli et al. | |
| 6,501,253 | B2 | 12/2002 | Marty | |
| 6,710,583 | B2 | 3/2004 | Stanescu et al. | |
| 6,828,764 | B2 | 12/2004 | Takimoto et al. | |
| 7,002,329 | B2 * | 2/2006 | Agari et al. | 323/284 |
| 7,015,680 | B2 | 3/2006 | Moraveji et al. | |
| 7,446,514 | B1 | 11/2008 | Li et al. | |
| 7,705,575 | B2 * | 4/2010 | Akyildiz et al. | 323/281 |

* cited by examiner

*Primary Examiner* — Shawn Riley

(57) ABSTRACT

A linear regulator and methods of regulation are provided. In one implementation, a linear regulator is provided. The linear regulator can receive an input voltage, generate an internal bias voltage in response to the received input voltage. The linear regulator can determine if the input voltage meets one or more first criteria and second criteria, and adjust an output voltage based on the internal bias voltage if the input voltage meets the one or more first criteria. The linear regulator also can supply the input voltage directly to the load if the input voltage meets the one or more second criteria. In some implementations, the linear regulator can generate an internal bias voltage that is clamped within a desired operating range if the input voltage meets the one or more first criteria, and adjusts one or more electronic circuits using the internal bias voltage to provide the adjusted output voltage.

21 Claims, 5 Drawing Sheets

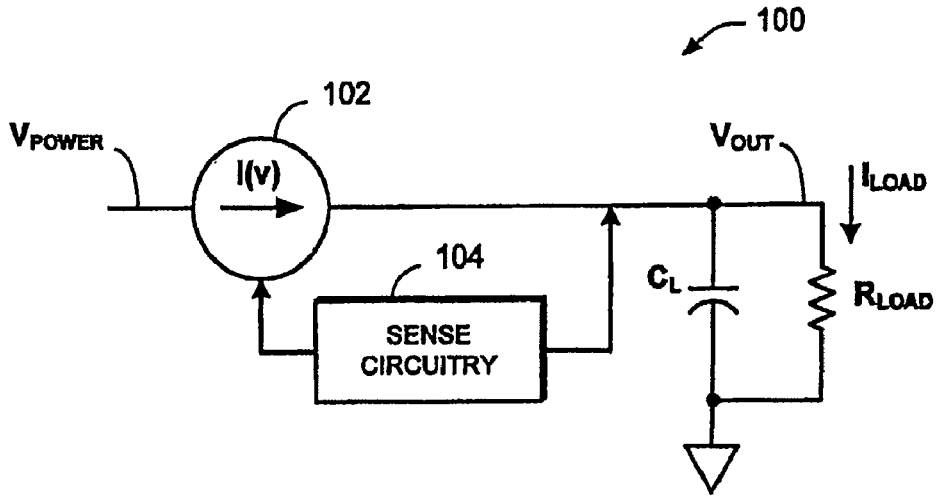
FIG._1 (*PRIOR ART*)
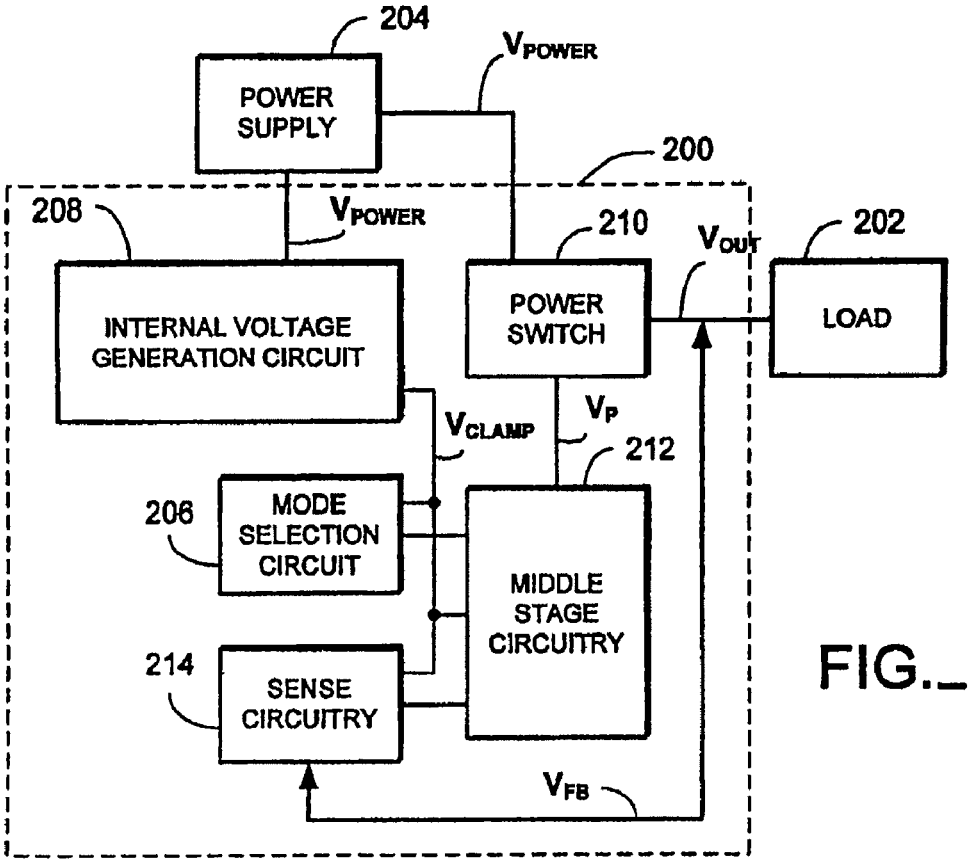
FIG._2

LINEAR REGULATION FOR USE WITH ELECTRONIC CIRCUITS

CROSS-REFERENCE TO RELATED APPLICATIONS

This application is a continuation application of U.S. patent application Ser. No. 12/264,118, filed on Nov. 3, 2008 which is a continuation application of U.S. patent application Ser. No. 11/095,039, filed on Mar. 30, 2005 which claims the benefit of priority to U.S. Provisional Patent Application No. 60/621,411, filed on Oct. 22, 2004, the disclosure of each of which is incorporated herein by reference in its entirety.

BACKGROUND

The following disclosure relates to electrical circuits and signal processing.

Electronic circuits typically operate using a constant supply voltage. A voltage regulator is a circuit that can provide a constant supply voltage, and includes circuitry that continuously maintains an output of the voltage regulator—i.e., the supply voltage—at a pre-determined value regardless of changes in load current or input voltage to the voltage regulator. One type of voltage regulator is a linear regulator. A linear regulator typically operates by using a voltage-controlled current source to force a fixed voltage to appear at an output of the linear regulator.

FIG. 1 shows a conventional linear regulator 100 that provides a regulated output voltage $V_{OUT}$ from a power source voltage $V_{POWER}$. Power source voltage $V_{POWER}$ can be supplied from a transformer (not shown). Linear regulator 100 includes a voltage-controlled current source 102, sense circuitry 104, a load capacitor $C_L$, and a resistive load $R_{LOAD}$. Sense circuitry 104 senses output voltage $V_{OUT}$, and adjust voltage-controlled current source 102 (as required by the resistive load $R_{LOAD}$) to maintain output voltage $V_{OUT}$ at a desired value (e.g., 5 volts). Load capacitor $C_L$ compensates for variations in a load current $I_{LOAD}$.

Conventional linear regulators are generally quite stable, however, in circumstances that a linear regulator receives a power source voltage (e.g., $V_{POWER}$) that is outside of (e.g., exceeds) the operating range of the linear regulator, stress problems may occur and the linear regulator may break down. For example, a linear regulator fabricated through a 5 volt CMOS process may break down if an associated power source (e.g., a transformer having large output fluctuations) supplies a power source voltage to the linear regulator that is greater than 6 volts.

SUMMARY

In general, in one aspect, this specification describes a linear regulator including a mode selection circuit operable to determine whether a power source voltage received by the linear regulator exceeds a pre-defined operational range of a load in communication with the linear regulator, and a power switch to directly supply the power source voltage to the load if the power source voltage is within the pre-defined operational range.

Particular implementations can include one or more of the following features. The power switch can be controlled to supply a regulated voltage to the load if the power source voltage exceeds the pre-defined operational range. The linear regulator can further include sense circuitry operable sense the regulated voltage to the load and substantially maintain the regulated voltage at a pre-determined voltage level. The linear regulator can further include an internal voltage generation circuit operable to generate a substantially stable internal bias reference for the sense circuitry. The linear regulator can further include middle stage circuitry operable to substantially shut off current flow to the sense circuitry and the middle stage circuitry itself when the power source voltage is directly supplied to the load.

The power switch can include a first transistor operable to directly supply the power source voltage to the load if the power source voltage is within the pre-defined operational range. The sense circuitry can include an operational transconductance amplifier operable to regulate an output voltage to the load if the power source voltage exceeds the pre-defined operational range. The operational transconductance amplifier can regulate the output voltage to the load through a second transistor in communication with an output of the operational transconductance amplifier. The operational transconductance amplifier can be connected in a negative feedback arrangement to regulate the output voltage. A transfer function associated with the linear regulator can be as follows:

$$H(s) = \frac{(g_{M_OTA\times} R_{OTA}) \times (g_{M_MN1\times} R_6) \times (g_{M_MP1\times} R_{OUT})}{R_{OUT\times} C_L S + 1} \times \frac{R_1}{R_{1+} R_2}$$

where $g_{M_OTA}$, $g_{M_MN1}$, $g_{M_MP1}$ represents a transconductance of the operational transconductance amplifier, the second transistor, and the first transistor, respectively, $R_{OUT}$ represents an output impedance of an output of the linear regulator, and $R_1$ and $R_2$ represent resistances associated with the negative feedback arrangement.

The linear regulator can further include a power supply operable to provide the power source voltage to the linear regulator. The power source voltage can be a fluctuating voltage that, at times, exceeds the operational range of the linear regulator.

In general, in another aspect, this specification describes a linear regulator including a comparator operable to compare a power source voltage to a reference voltage, and a first transistor operable to directly supply the power source voltage to a load if the power source voltage is less than the reference voltage.

Particular implementations can include one or more of the following features. The linear regulator can further include an operational transconductance amplifier operable to regulate an output voltage to the load if the power source voltage is greater than the reference voltage. The linear regulator can be substantially a one-pole system.

In general, in another aspect, this specification describes a method including determining whether a power source voltage received by a linear regulator exceeds a pre-defined operational range of a load in communication with the linear regulator, and directly supplying the power source voltage to the load if the power source voltage is within the pre-defined operational range.

Particular implementations can include one or more of the following features. The method can further include supplying a regulated voltage to the load if the power source voltage exceeds the pre defined operational range. The method can further include sensing the regulated voltage to the load and substantially maintaining the regulated voltage at a predetermined voltage level. The method can further include generating a stable internal bias reference for the linear regulator. The method can further include substantially shutting off current flow within the linear regulator when the power source voltage is directly supplied to the load. The method can further include providing the power source voltage to the linear regulator. The power source voltage can be a fluctuating voltage that, at times, exceeds the operational range of the linear regulator.

In general, in another aspect, this specification describes a linear regulator including means for determining whether a power source voltage received by the linear regulator exceeds a pre-defined operational range of a load in communication with the linear regulator, and means for directly supplying the power source voltage to the load if the power source voltage is within the pre-defined operational range.

Particular implementations can include one or more of the following features. The linear regulator can include means for supplying a regulated voltage to the load if the power source voltage exceeds the pre-defined operational range. The linear regulator can further include means for sensing the regulated voltage to the load and substantially maintaining the regulated voltage at a pre-determined voltage level. The linear regulator can further include means for generating a substantially stable internal bias reference for the means for sensing. The linear regulator can further include means for substantially shutting off current flow to the means for sensing when the power source voltage is directly supplied to the load.

The linear regulator can include a first switching means for directly supplying the power source voltage to the load if the power source voltage is within the pre-defined operational range. The means for sensing can include means for regulating an output voltage to the load if the power source voltage exceeds the pre-defined operational range. The means for regulating can regulate the output voltage to the load through a second switching means in communication with an output of the means for regulating. The means for regulating can be connected in a negative feedback arrangement to regulate the output voltage. A transfer function associated with the linear regulator can be as follows:

$$H(s) = \frac{(g_{M_OTA} \times R_{OTA}) \times (g_{M_MN1} \times R_6) \times (g_{M_MP1} \times R_{OUT})}{R_{OUT} \times C_L S + 1} \times \frac{R_1}{R_1 + R_2}$$

where $g_{M_OTA}$, $g_{M_MN1}$, $g_{M_MP1}$ represents a transconductance of the means for regulating, the second switching means, and the first switching means, respectively, $R_{OUT}$ represents an output impedance of an output of the linear regulator, and $R_1$ and $R_2$ represent resistances associated with the negative feedback arrangement. The linear regulator can further include means for providing the power source voltage to the linear regulator.

In general, in another aspect, this specification describes a linear regulator including means for comparing a power source voltage to a reference voltage, and a first switching means operable to directly supply the power source voltage to a load if the power source voltage is less than the reference voltage.

Particular implementations can include one or more of the following features. The linear regulator can further include means for regulating an output voltage to the load if the power source voltage is greater than the reference voltage.

Implementations can include one or more of the following advantages. A linear regulator is provided that can receive a power source voltage that is supplied from an inexpensive transformer—e.g., the transformer can supply a power source voltage having large voltage fluctuations. For example, in one implementation, a linear regulator fabricated through a 5 volt CMOS process can be supplied a power source voltage that varies from, e.g., 4.5-9 volts. When the power source voltage is within an operating range of an associated linear regulator and/or load, the linear regulator can directly supply the power source voltage as an output of the linear regulator without any voltage regulation, therefore, reducing power dissipation of the linear regulator. In one implementation, when the power source voltage is outside of the operating range of the linear regulator and/or load, there are no stress issues for the linear regulator due to an internally generated supply voltage. In one implementation, a linear regulator is provided that has one-dominant-pole which permits the linear regulator to be unconditionally stable.

The details of one or more implementations are set forth in the accompanying drawings and the description below. Other features and advantages will be apparent from the description and drawings, and from the claims.

DESCRIPTION OF DRAWINGS

FIG. 1 is a block diagram of a conventional linear regulator.

FIG. 2 is a block diagram of a linear regulator.

Like reference symbols in the various drawings indicate like elements.

DETAILED DESCRIPTION

Figure 3:
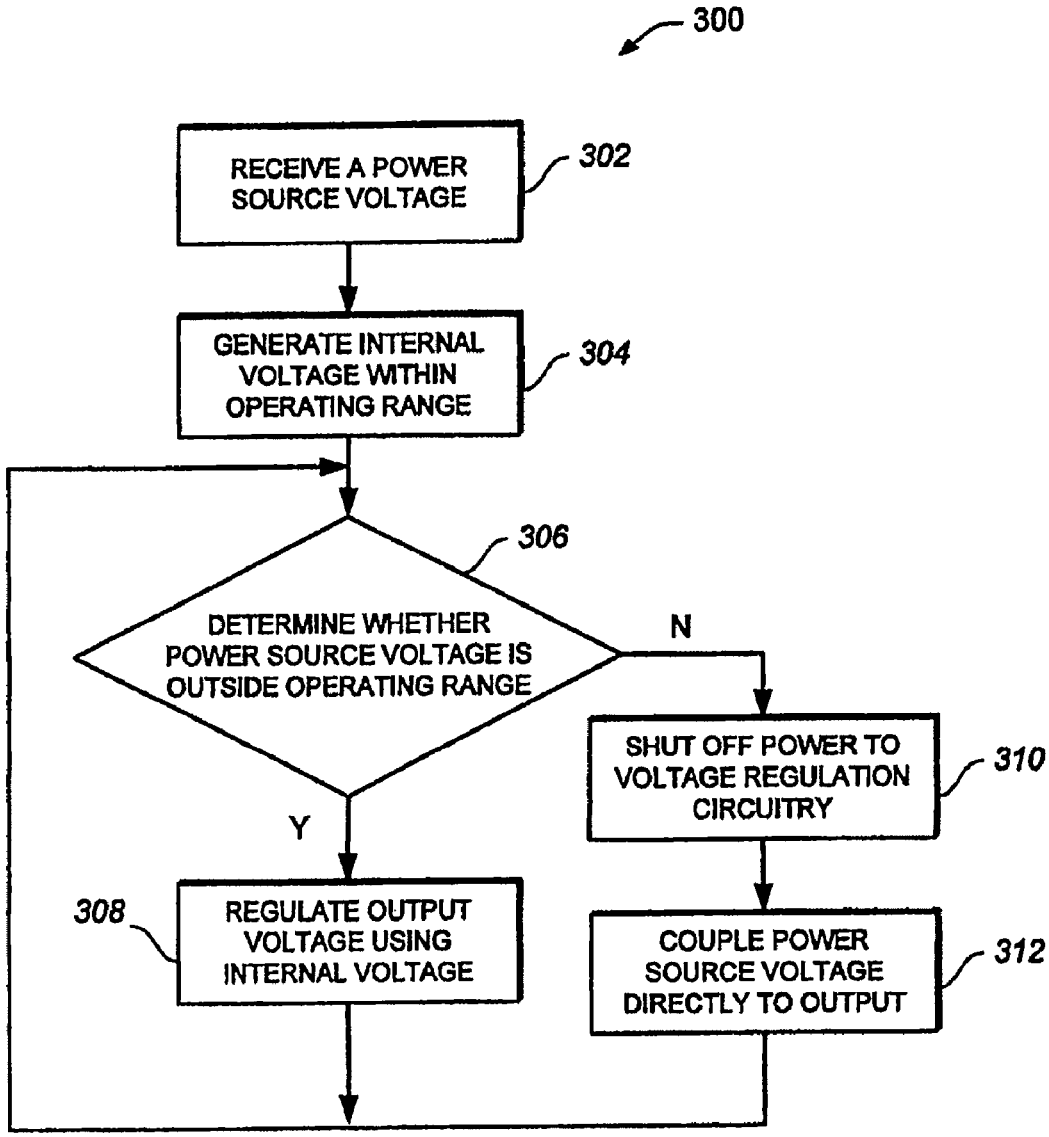
FIG. 3 is a method for operating the linear regulator of FIG. 2.

FIG. 2 is a block diagram of a linear regulator 200 for supplying a regulated output voltage $V_{OUT}$ to a load 202. Load 202 can be any type of electronic circuit that receives a substantially constant voltage source. In one implementation, linear regulator 200 receives an input signal (e.g., a power source voltage $V_{POWER}$) from a power supply 204 (e.g., a transformer) that can fluctuate outside of the operating range of linear regulator 200 and/or load 202. In one implementation, linear regulator 200 includes an mode selection circuit 206, internal voltage generation circuit 208, a power switch 210, middle stage circuitry 212, and sense circuitry 214.

Mode selection circuit 206 includes circuitry for determining a mode of operation for linear regulator 200. In one implementation, linear regulator 200 operates according to two modes (i.e., one mode at any given time)—a regulating mode and a direct-supplying mode. In the regulating mode, linear regulator 200 is controlled to output a regulated (or monitored) output voltage $V_{OUT}$ (through power switch 208). In the direct-supplying mode, linear regulator 200 is controlled to couple (or supply) power source voltage $V_{POWER}$ (from power supply 200) directly to load 202, without any voltage regulation. In one implementation, mode selection circuit 206 determines a mode of operation for linear regulator 200 based on a voltage level of power source voltage $V_{POWER}$. That is, if the power source voltage $V_{POWER}$ exceeds the operating range of linear regulator 200 and/or load 202, then linear regulator 200 operates according to the regulating mode. And, if the power source voltage $V_{POWER}$ is within the operating range of linear regulator 200 and/or load 202, linear regulator 200 operates according to the direct-supplying mode.

Internal voltage generation circuit 208 generates a substantially stable internal bias reference (e.g., voltage $V_{CLAMP}$) that is used to supply a bias voltage to circuitry within linear regulator 200—e.g., mode selection circuit 206, middle stage circuitry 212, and sense circuitry 214. In one implementation, voltage $V_{CLAMP}$ is supplied to circuitry within linear regulator 200 all the time. In one implementation, voltage $V_{CLAMP}$ is always substantially within the operating range of circuitry within linear regulator 200 even though the power source voltage $V_{POWER}$ may fluctuate or exceed the operating range of linear regulator 200. For example, if the power source voltage changes from 4.5 volts to 9 volts, then voltage $V_{CLAMP}$, in one implementation, will accordingly change from 4.5 volts to 5.5 volts. Internal voltage generation circuit 208 can include any type of circuitry (e.g., one or more diode-connected MOSFET transistors as described below) for generating a substantially stable internal bias voltage $V_{CLAMP}$.

Power switch 210 operates to couple output $V_{OUT}$ of linear regulator 200 to power source voltage $V_{POWER}$. Power switch 210 can include one or more transistors (not shown). Power switch 210 can be controlled by a control voltage VP, as discussed in greater detail below. In one implementation, power switch 210 directly couples power source voltage $V_{POWER}$ to output $V_{OUT}$ (i.e., power switch 200 is fully on (or closed)) when power source voltage $V_{POWER}$ is within the operating range of linear regulator 200 and/or load 202. When power source voltage $V_{POWER}$ exceeds the operating range of linear regulator 200 and/or load 202, power switch 210 is controlled to supply a regulated output voltage $V_{OUT}$ to load 202.

Middle stage circuitry 212 includes circuitry for reducing a power consumption of linear regulator 200 when linear regulator 200 is operating in the direct-supplying mode, i.e., when power source voltage $V_{POWER}$ is within the operating range of linear regulator 200 and/or load 202. In one implementation, current flow to middle stage circuitry 212 and sense circuitry 214 is substantially shut off when power source voltage $V_{POWER}$ is being directly coupled (or supplied) to output $V_{OUT}$ of linear regulator 200. As discussed in greater detail below, sense circuitry 214 can include one or more operational transconductance amplifiers. Middle stage circuitry 212 further includes one or more transistors (not shown) that are controlled by the internally generated voltage $V_{CLAMP}$ to protect one or more transistors (not shown) within linear regulator 200 from stress (or reaching a breakdown voltage) when $V_{POWER}$ exceeds the operating range of linear regulator 200, one implementation of which is discussed below in association with FIGS. 4A-4C.

Sense circuitry 214 includes circuitry for regulating output voltage $V_{OUT}$ when linear regulator 200 is operating in the regulating mode, i.e., when power source voltage $V_{POWER}$ exceeds the operating range of linear regulator 200 and/or load 202. Sense circuitry 214 is operable to maintain a regulated output voltage at a pre-determined voltage level. In one implementation, sense circuitry 214 operates using voltage $V_{CLAMP}$ as a bias voltage reference. Sense circuitry 214 can include any type of sensing circuitry for sensing an output voltage and generating a control signal responsive to the sensed output voltage.

FIG. 3 shows a process 300 for regulating an output voltage of a linear regulator (e.g., linear regulator 200). A power source voltage (e.g., power source voltage $V_{POWER}$) is received by the linear regulator (step 302). In one implementation, the power source voltage is a fluctuating voltage generated by a transformer, which power source voltage can exceed an operating range of the linear regulator and/or an associated load (e.g., load 202). A substantially stable internal bias reference (e.g., voltage $V_{CLAMP}$) is generated (e.g., using internal voltage generation circuit 208) (step 304). The substantially stable internal bias reference can be used to supply a bias voltage to circuitry within the linear regulator. For example, in one implementation, sense circuitry associated with the linear regulator is supplied a substantially stable internally generated bias reference that is within an operating range of one or more transistors associated with the sense circuitry.

A determination is made (e.g., through mode selection circuit 206) whether the power source voltage is outside (e.g., exceeds) the operating range of the linear regulator and/or the associated load (step 306). If the power source voltage is outside (e.g., exceeds) the operating range of the linear regulator and/or load, then the output voltage of the linear regulator is regulated (e.g., through sense circuitry 214) using the internally generated bias reference (step 308).

If the power source voltage is not outside the operating range of the linear regulator and/or the associated load, then power is substantially shut off to voltage regulation circuitry (e.g., using middle stage circuitry 212) (step 310). In one implementation, current is substantially shut off to the sense circuitry and middle stage circuitry associated with the linear regulator. The power source voltage is directly coupled to the output of the linear regulator (e.g., through power switch 210) (step 312). After steps 308, 312, method 300 returns to step 304, discussed above.

Figures 4A, 4B, 4C:
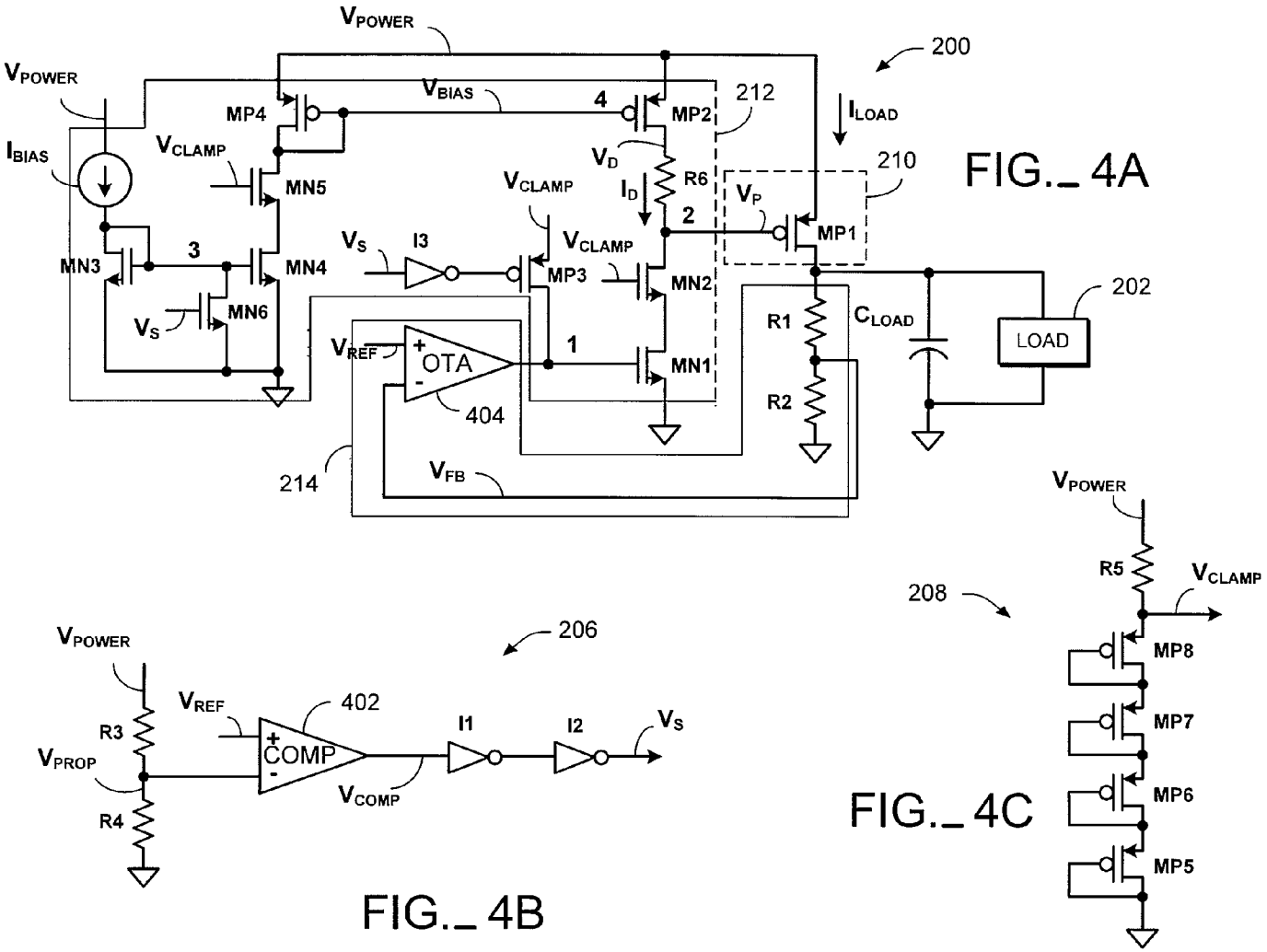
FIGS. 4A-4C are schematic diagrams of portions of the linear regulator of FIG. 2.

FIGS. 4A-4C illustrate one implementation of linear regulator 200, including mode selection circuit 206 (FIG. 4B), internal voltage generation circuit 208 (FIG. 4C), power switch 210, middle stage circuitry 212, and sense circuitry 214. In one implementation, linear regulator 200 is fabricated through a 5 volt CMOS process. Of course, other appropriate processes may be utilized. In such an implementation, linear regulator 200 includes transistors and other circuitry (as discussed below) that have an operating range of below substantially 6 volts.

Referring to FIGS. 4A-4C, mode selection circuit 206 includes resistors R3-R4, a comparator 402, and inverters I1-I2. Internal voltage generation circuit 208 includes resistor R5, and PMOS transistor MP5, MP6, MP7, MP8. Power switch 210 includes a PMOS transistor MP1. Middle stage circuitry 212 includes resistor R6, NMOS transistors MN1, MN2, MN3, MN4, MN5, MN6, PMOS transistors MP2, MP3, MP4, an inverter I3, and a current source $I_{BIAS}$. Sense circuitry 214 includes resistors R1-R2, and an operational transconductance amplifier 404. As discussed above, in one implementation, linear regulator 200 operates in two modes—a regulating mode and a direct-supplying mode—as determined by mode selection circuit 206.

Regulating Mode

In operation during regulating mode, power source voltage $V_{POWER}$ exceeds an operating range of linear regulator 200—e.g., power source voltage varies between 6-9 volts. In response, comparator 402 (of mode selection circuit 206) compares a reference voltage $V_{REF}$ to a voltage $V_{PROP}$ that is directly proportional to power source voltage $V_{POWER}$. If voltage $V_{PROP}$ is greater than reference voltage $V_{REF}$, then mode selection circuit pulls control signal $V_{COMP}$ (and $V_S$) to a low voltage level. Inverters I1-I2 are buffers that increase a drive capability of control signal $V_{COMP}$. The buffered control signal $V_S$ is provided to an input to an inverter I3 in middle stage circuitry 212. Transistor MP3 is turned off, and an output of operational transconductance amplifier 404 of sense circuitry 214 is activated to regulate the output voltage $V_{OUT}$ of linear regulator 200.

In one implementation, operational transconductance amplifier 404 is connected in a negative feedback arrangement to equalize reference voltage $V_{REF}$ and a feedback voltage $V_{FB}$. Voltage $V_{OUT}$ is given by the following equation:

$$V_{OUT} = \left(1 + \frac{R1}{R2}\right) \times V_{REF} \quad \text{(eq. 1)}$$

where $V_{REF}$ is a reference voltage that can represent a bandgap voltage (e.g., 1.2 volts).

The output voltage $V_{OUT}$ is further regulated by controlling an amount of dissipation current $I_D$ through resistor R6, and NMOS transistors MN1, MN2 in middle stage circuitry 212. A voltage drop across resistor R6—i.e., the product of resistor R6 and dissipation current $I_D$—defines the $V_{GS}$ (gate-to-source voltage) of PMOS transistor MP1. By controlling the $V_{GS}$ of PMOS transistor MP1, a load current through PMOS transistor MP1 can be accordingly reduced (or increased) during the regulating mode of linear regulator 200.

Dissipation current $I_D$ is controlled as follows. A current mirror formed by NMOS transistors MN3, MN4 provide a biasing current for diode-connected PMOS transistor MP4. In turn, the diode-connected PMOS transistor MP4 generates a biasing voltage $V_{BIAS}$ to control PMOS transistor MP2. PMOS transistor MP2 behaves as a switch (i.e., due to a large W/L ratio), and voltage $V_D$ at the drain of PMOS transistor MP2 is pulled up to substantially equal power source voltage $V_{POWER}$. Dissipation current $I_D$ flowing through resistor R6, and NMOS transistors MN1, MN2, is given by the following equation:

$$I_D = \left(\frac{V_{POWER} - V_P}{R6}\right) \quad \text{(eq. 2)}$$

where $V_P$ is defined by the $V_{GS}$ of PMOS transistor MP1.

Because power voltage source $V_{POWER}$ can exceed the breakdown voltage of the CMOS transistors within linear regulator 200, internal voltage generation circuit 208 generates a substantially stable internal bias voltage $V_{CLAMP}$ to supply a proper supply voltage to circuitry within linear regulator 200. Referring to FIG. 4C, internal voltage generation circuit 208 includes 4 diode-connected PMOS transistors MP5-MP8 and resistor R5 that provide a bias voltage $V_{CLAMP}$ that is clamped within the range of, for example 4.5-5.5 volts. In the implementation shown, NMOS transistors MN2, MN5 have gates connected to bias voltage $V_{CLAMP}$ to protect NMOS transistors MN1, MN4 from exceeding a breakdown voltage, even though power source voltage $V_{POWER}$ may be greater than the breakdown voltage.

In one implementation, the value of resistor R6 and the size (i.e., W/L ratio) of NMOS transistor MN1 are small to avoid any issues with stability. For example, in one implementation, resistor R6 has a value of 10 k ohms and NMOS transistor MN1 has a W/L ratio of 2.5 μm/3.5 μm. The poles at nodes 1 and 2 (FIG. 4A) have a value of $$\frac{1}{R_{OTA} \times C_{PAR}} \text{ and } \frac{1}{R_6 \times C_{GATE}},$$

respectively, in which $R_{OTA}$, $C_{PAR}$, and $C_{GATE}$ represent an output impedance of operational transconductance amplifier 404, a parasitic capacitance at node 1, and a gate capacitance of PMOS transistor MP1. The poles at nodes 1 and 2 are pushed to high frequencies and therefore linear regulator 200 can be considered as a one-pole system, having a transfer function as follows:

$$H(s) = \frac{(g_{M_OTA} \times R_{OTA}) \times (g_{M_MN1} \times R_6) \times (g_{M_MP1} \times R_{OUT})}{R_{OUT} \times C_L S + 1} \times \frac{R_1}{R_1 + R_2} \quad \text{(eq. 3)}$$

in which $g_{M_OTA}$, $g_{M_MN1}$, $g_{M_MP1}$ represents the transconductance of operational transconductance amplifier 404, NMOS transistor MN1, and PMOS transistor MP1, respectively, and $R_{OUT}$ represents an output impedance at output $V_{OUT}$.

Direct-Supplying Mode

In operation during direct-supplying mode, power source voltage $V_{POWER}$ is within an operating range of linear regulator 200—e.g., power source voltage varies below 6 volts. In response, comparator 402 (of mode selection circuit 206) pulls control signal $V_{COMP}$ (and $V_S$) to a high voltage level. Node 3 is pulled low through NMOS transistor MN6, and the biasing current flowing through NMOS transistors MN4, MN5 and PMOS transistor MP4 is cut off. Thus, biasing voltage $V_{BIAS}$ is pulled up to substantially equal power source voltage $V_{POWER}$ and PMOS transistor MP2 is turned off. Also, the gate of PMOS transistor MP3 is pulled low to fully turn on PMOS transistor MP3, which causes node 1 to be pulled up to be substantially equal to bias voltage $V_{CLAMP}$. NMOS transistors MN1, MN2 are fully on, while PMOS transistor MP2 is off. As a result node 2—i.e., control signal $V_P$—is pulled to a low voltage level, and PMOS transistor MP1 is fully activated to supply power source voltage $V_{POWER}$ directly to load 202 without any voltage regulation. Middle stage circuitry 212 pulls node 4—i.e., bias voltage $V_{BIAS}$ high—to substantially shut off PMOS transistor MP2. Thus, no current flows through, e.g., middle stage circuitry 212 and sense circuitry 214, which reduces power dissipation of linear regulator 200 during times that power source voltage $V_{POWER}$ is substantially stable. In one implementation, the resistance value of resistor R6 is small, and therefore cutting off current flowing through resistor R6 reduces a large amount of power dissipation within linear regulator 200.

Figure 5:
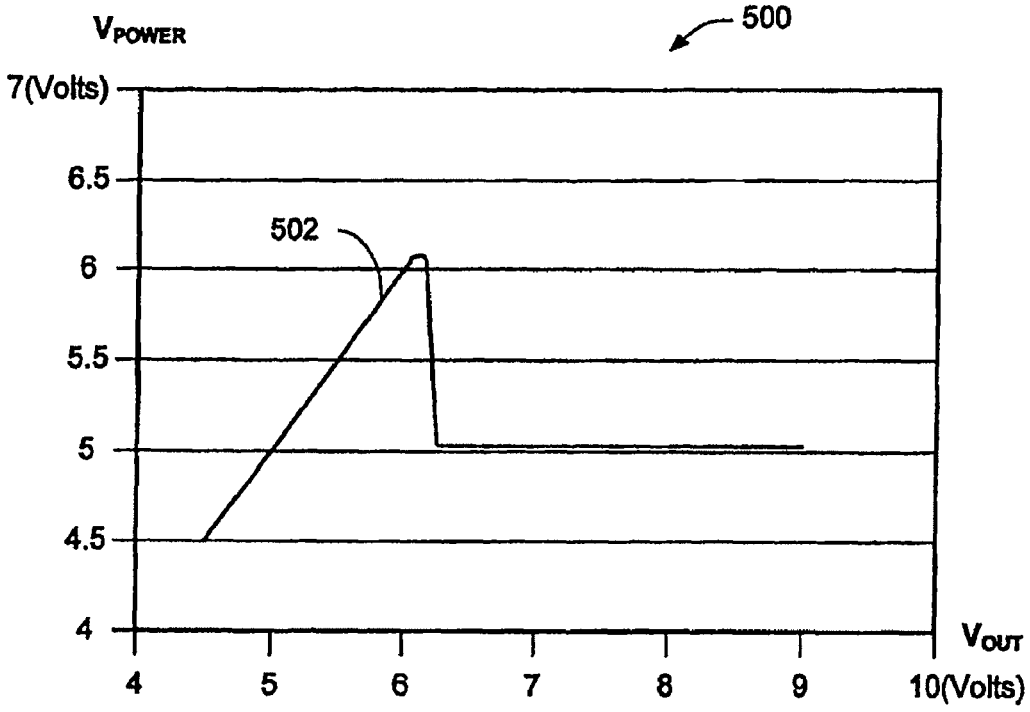
FIG. 5 is graph of an output voltage of the linear regulator of FIG. 2.
Figure 6:
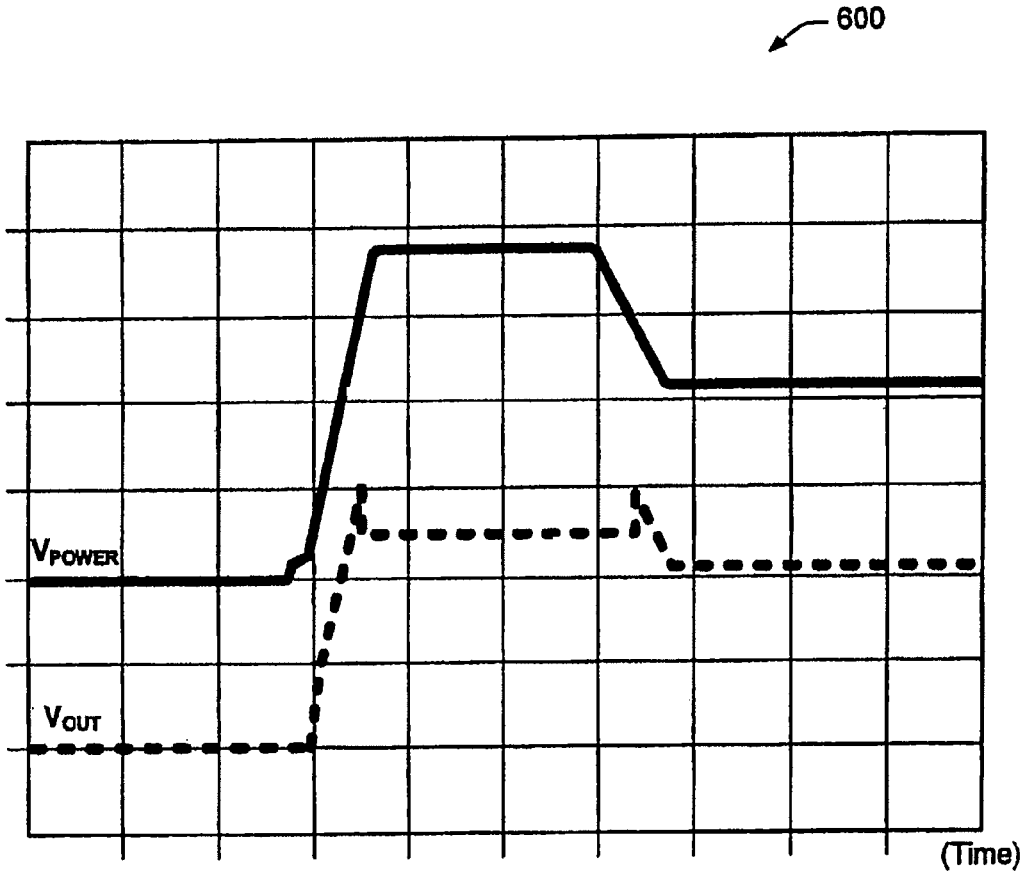
FIG. 6 is a graph of a transient response waveform of the linear regulator of FIG. 2

FIG. 5 shows a graph 500 of output voltage $V_{OUT}$ in response to a fluctuating power source voltage $V_{POWER}$. As shown in FIG. 5, curve 502 rises linearly in an unregulated fashion until power source voltage $V_{POWER}$ (and output voltage $V_{OUT}$) reaches 6 volts (a breakdown threshold for 5 volt CMOS transistors). At this voltage, linear regulator 200 begins to regulate output voltage $V_{OUT}$ at substantially 5 volts as power source voltage $V_{POWER}$ continues to rise. FIG. 6 shows a graph 600 of a transient response waveform of linear regulator 200. The transient response waveform represents a measure of how fast linear regulator 200 returns to steady-state conditions after a load change (e.g., a change in load current to load 202).

Figure 7:
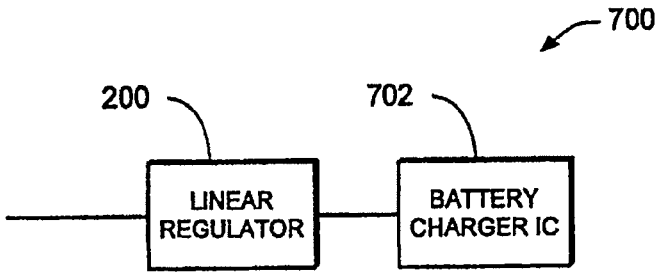
FIG. 7 is a block diagram of a circuit application including the linear regulator of FIG. 2.

Linear regulator 200 can be used in a wide range of applications. For example, linear regulator 200 can be used with circuitry of a battery charger circuit 700, as shown in FIG. 7. In particular, linear regulator 200 can be used to supply a substantially stable bias voltage to battery charger integrated circuit 702, even though a power supply (not shown) (which supplies power to linear regulator 200) may have a fluctuating power source voltage. Battery charger circuit 700 can be used to charge electronic circuits and devices having re-chargeable batteries. For example, electronic devices can include cellular phones, MP3/MP4 players, digital cameras, and so on. In one implementation, when a re-chargeable battery is fully charged (e.g., by battery charger circuit 700), battery charger circuit 700 goes into a stand-by mode. While battery charger circuit 700 is in a stand-by mode, linear regulator 200 can directly supply the power source voltage received from the power supply (not shown) to battery charger circuit 700, according to the direct-supplying mode described above. During this mode of operation, current is substantially shut off to voltage regulating circuitry within linear regulator 200, which reduces power dissipation and heat generation within battery charger circuit 700.

A number of implementations have been described. Nevertheless, it will be understood that various modifications may be made without departing from the spirit and scope of the invention. For example, steps of methods described above can be performed in a different order. Accordingly, other implementations are within the scope of the following claims.

What is claimed is:

1. A method comprising:

receiving an input voltage;

generating an internal bias voltage in response to the received input voltage;

determining if the input voltage meets one or more first criteria and second criteria;

adjusting an output voltage based on the internal bias voltage if the input voltage meets the one or more first criteria; and supplying the input voltage directly to the load if the input voltage meets the one or more second criteria, wherein:

generating the internal bias voltage includes generating an internal bias voltage that is clamped within a desired operating range if the input voltage meets the one or more first criteria; and adjusting the output voltage includes adjusting one or more electronic circuits using the internal bias voltage to provide the adjusted output voltage.

2. The method of claim 1, comprising disabling circuitry associated with adjusting the output voltage if the input voltage meets the one or more second criteria.

3. The method of claim 2, wherein disabling the circuitry includes disabling one or more internal circuits, the one or more internal circuits configured to adjust the output voltage.

4. The method of claim 2, comprising supplying the internal bias voltage to the circuitry associated with adjusting the output voltage if the input voltage meets the one or more first criteria.

5. The method of claim 1, wherein determining if the input voltage meets the one or more first criteria includes determining if the input voltage is within an operating voltage range of a voltage regulator through which the input voltage is received.

6. A device comprising:

circuitry configured to:

generate an internal bias voltage in response to an input voltage;

determine if the input voltage meets one or more first criteria and second criteria;

adjust an output voltage at a load based on the internal bias voltage if the input voltage meets the one or more first criteria; and a power switch configured to supply the input voltage directly to the load if the input voltage meets the one or more second criteria, wherein:

the internal bias voltage includes an internal bias voltage that is clamped within a desired operating range if the input voltage meets the one or more first criteria; and the circuitry is configured to adjust one or more electronic circuits using the internal bias voltage to provide the adjusted output voltage.

7. The device of claim 6, wherein the power switch is configured to supply the input voltage directly to the load without any adjustment to the output voltage if the input voltage meets the one or more second criteria.

8. The device of claim 6, wherein the input voltage is a fluctuating power source voltage generated by a transformer.

9. The device of claim 8, wherein the circuitry is further configured to determine if the fluctuating power source voltage is within an operating voltage range of the device.

10. The device of claim 6, wherein the circuitry includes internal voltage generation circuitry configured to generate the internal bias voltage in response to the input voltage, the internal bias voltage being a constant bias voltage.

11. The device of claim 10, wherein the internal voltage generation circuitry includes a plurality of transistors and a resistor connected in series to provide the constant bias voltage.

12. The device of claim 10, wherein the circuitry includes sense circuitry configured to receive the constant bias voltage, and adjust the output voltage at the load based on the constant bias voltage.

13. The device of claim 12, wherein the sense circuitry includes an operational transconductance amplifier configured to adjust the output voltage at the load if the input voltage meets the one or more first criteria.

14. The device of claim 13, wherein the operational transconductance amplifier is configured to receive a feedback voltage connected to the load and a reference voltage to adjust the output voltage.

15. The device of claim 12, wherein the circuitry includes middle stage circuitry configured to disable the sense circuitry, if the input voltage meets the one or more second criteria, to reduce power consumption of the device.

16. The device of claim 15, wherein:

the power switch includes a switching transistor configured to further adjust the output voltage using a load current flowing through the switching transistor; and the middle stage circuitry includes a resistor configured to generate a dissipation current and to control the load current based on the dissipation current.

17. The device of claim 16, wherein the middle stage circuitry regulates a voltage drop across the resistor to control the load current.

18. The device of claim 16, wherein:

the middle stage circuitry includes a current mirror, a first transistor and a second transistor, the second transistor connected to the resistor;

the current mirror is configured to generate a biasing current;

the first transistor is configured to generate a biasing voltage based on the biasing current to control the second transistor so as to generate a power source voltage substantially equal to the input voltage; and the dissipation current is controlled based on the power source voltage, a resistance of the resistor, and a gate-to-source voltage of the switching transistor.

19. The device of claim 6, further comprising a mode selection circuit to activate the power switch if the input voltage meets the one or more second criteria to supply the input voltage directly to the load without any voltage regulation.

20. The device of claim 6, wherein the one or more first criteria include the input voltage being within a predetermined voltage range, and the one or more second criteria include the input voltage being outside the predetermined voltage range.

21. A system comprising:

a charger circuit configured to operate in stand-by mode or operational mode; and a voltage regulator configured to:

receive an input voltage;

generate a constant bias output voltage based on the input voltage, supply the input voltage to the charger circuit without voltage regulation during the stand-by mode; and supply the constant bias output voltage to the charger circuit during the operational mode if the input voltage is outside an operational range of the voltage regulator, wherein:

the constant bias output voltage is generated from an internal bias voltage that is clamped within a desired operating range of the voltage regulator if the input voltage is outside the operational range of the voltage regulator; and the voltage regulator is configured to adjust one or more electronic circuits using the internal bias voltage in supplying the constant bias output voltage to the charger circuit.

* * * * *